US005999149A

United States Patent [19]

Lee et al.

[11] Patent Number: 5,999,149

[45] **Date of Patent: *Dec. 7, 1999**

[54] MATRIX DISPLAY WITH PERIPHERAL DRIVE SIGNAL SOURCES

[75] Inventors: John K. Lee; Glen Hush, both of Boise, Id.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/827,022

[22] Filed: Mar. 25, 1997

Related U.S. Application Data

[63] Continuation of application No. 08/458,853, Jun. 2, 1995, Pat. No. 5,638,086, which is a continuation of application No. 08/138,538, Oct. 15, 1993, abandoned.

[51] Int. Cl.[6] ..... G09G 3/22

[52] U.S. Cl. ..... 345/74; 315/169.1

[58] Field of Search ..... 345/74, 75, 55; 315/169.1, 169.3, 366, 167, 334, 339, 349

[56] References Cited

U.S. PATENT DOCUMENTS

| | | | |
|---|---|---|---|
| 4,326,151 | 4/1982 | Weisbrod | 315/410 |
| 4,349,816 | 9/1982 | Miller et al. | 340/781 |
| 4,554,539 | 11/1985 | Graves | 340/805 |
| 4,857,799 | 8/1989 | Spindt | 313/495 |
| 4,866,349 | 9/1989 | Weber et al. | 315/169.4 |
| 4,908,539 | 3/1990 | Meyer | 315/169.3 |
| 5,103,144 | 4/1992 | Dunham | 315/366 |
| 5,103,145 | 4/1992 | Doran | 315/366 |
| 5,153,483 | 10/1992 | Kishino et al. | 315/169.3 |
| 5,157,309 | 10/1992 | Parker et al. | 315/169.1 |
| 5,162,704 | 11/1992 | Kobori et al. | 315/349 |
| 5,210,472 | 5/1993 | Casper et al. | 315/349 |
| 5,283,500 | 2/1994 | Kochanski | 315/169.3 |
| 5,313,140 | 5/1994 | Smith et al. | 315/169.1 |
| 5,357,172 | 10/1994 | Lee et al. | 315/167 |
| 5,387,844 | 2/1995 | Browning | 315/169.3 |
| 5,404,081 | 4/1995 | Kane et al. . | |
| 5,410,218 | 4/1995 | Hush . | |
| 5,616,991 | 4/1997 | Casper et al. | 315/167 |
| 5,631,664 | 5/1997 | Adachi et al. . | |
| 5,638,086 | 6/1997 | Lee et al. | 345/74 |
| 5,642,017 | 6/1997 | Hush . | |
| 5,783,910 | 7/1998 | Casper et al. . | |

FOREIGN PATENT DOCUMENTS

| | | | |
|---|---|---|---|
| 92/05571 | 4/1992 | WIPO | H01J 1/02 |

*Primary Examiner*—Regina Liang
*Attorney, Agent, or Firm*—William R. Bachand; Robert J. Stern

[57] ABSTRACT

A display is arranged in rows and columns with a current source for each column instead of a current source in each display cell. By omitting the current source from the cell, smaller display cell geometries are achieved. In a display where one row is selected at a time, the display of the present invention with smaller circuitry achieves performance identical to the prior art. Application is made to flat panel displays generally including field emission displays, liquid crystal displays, and integrated light emitting diode array displays.

46 Claims, 3 Drawing Sheets

MATRIX DISPLAY WITH PERIPHERAL DRIVE SIGNAL SOURCES

This application is a continuation of application Ser. No. 08/458,853 filed Jun. 2, 1995, now U.S. Pat. No. 5,638,086, which is a continuation of application Ser. No. 08/138,535 filed Oct. 15, 1993, now abandoned.

TECHNICAL FIELD

The present invention relates to high density addressable matrix displays and particularly to matrix displays formed on an integrated circuit substrate.

BACKGROUND

As one example of a high density display, consider a field emission display including a phosphor display panel and an array of perhaps thousands of pixelators, each pixelator directed to excite a small region of the display panel. The region excited by one pixelator is called a "pixel" from the contraction of the words picture element. Excitation is generally accomplished by a beam of electrons radiated from a sharp tip structure within the pixelator. Current for the electron beam is supplied to the pixelator as a drive signal from a current source.

The conventional pixelator includes a tip, a current source in series with the tip for providing current for the electron beam, and one or more switches between the source and the tip for enabling the pixelator. In a conventional field emission display, each pixelator can be independently enabled since each has an independent current source. By co-locating the independent current source and the tip, quick pixelator response times are possible because interconnect capacitance between the current source and the tip is minimal.

In addition to quick response time, improved display resolution is highly desirable. Due to the one-to-one spacial relationship between pixelators and displayed pixels, decreased pixel size dictates decreased pixelator size. The size of the conventional pixelator is dominated by the size of the current source made necessary for quick response times.

The difficulties described above with respect to field emission displays find parallels in other display technologies. Conductors used to distribute the drive signal occupy space and so limit the resolution of matrix displays having an array of rows and columns of cells. Matrix display cells include field emission cells, liquid crystal display elements, light modulators, and light emitting cells.

In view of the problems described above and related problems that consequently become apparent to those skilled in the applicable arts, the need remains in high density display technologies for low cost displays of increased resolution. Such displays would find application in laptop computers having monochrome or color displays, image display and monitoring systems, instrumentation, consumer equipment, measurement apparatus, and similar applications including battery powered portable equipment requiring an information or graphic display. Conventional high density displays for these applications are expensive due to factors related to pixelator size and complexity. Complex pixelator design directly increases die size, decreases manufacturing yield, and decreases system reliability.

SUMMARY

Accordingly, a high density display in one embodiment of the present invention is responsive to a row signal and a column signal for displaying a pixel. The display includes an array of display cells formed on a substrate, a supply for providing display current to a plurality of cells, and a predetermined cell of the array that has been enabled for displaying a pixel. The array is arranged to form at least one row and at least one column, the row and column intersecting at the predetermined cell. The supply provides a current to a plurality of cells of one column. The predetermined cell is enabled for displaying the pixel by receiving the row signal, the column signal, and a portion of the display current.

According to a first aspect of such a display, the display cell does not include a current source. By eliminating the current source from each display cell, the display cell is made smaller, the pixel becomes smaller, and more display cells can be fabricated per unit area. With more display cells per unit area, display resolution is increased.

According to another aspect of such a display, a current source serves the current supply requirements of an entire column of display cells. Fewer current sources are needed for a complete display so the overall die size is smaller than the conventional display. Smaller die size allows more die per wafer. Consequently, displays are produced at lower cost.

According to another aspect of such a display, by serving a number of display cells from a common current source, the complexity of each display cell is reduced. Reducing complexity increases manufacturing yield and increases display reliability.

In another embodiment of the present invention, a field emission display is formed on a semiconductor substrate. The display includes an array of cells arranged in a plurality of intersecting rows and columns, means for identifying a cell at a predetermined intersection, and means coupled to a bus for providing the drive signal. The predetermined intersection is defined by a selected row and a selected column. The bus couples the drive signal in parallel to a plurality of cells of the selected column.

According to a first aspect of such a field emission display, a more sophisticated drive signal source is feasible within the conventional die size. By omitting the individual drive signal source from each pixelator, smaller pixelators result. Die space is freed for drive signal sources arranged, for example, outside the pixelator array. Such drive signal sources can employ more sophisticated circuitry for increased functionality including controlling brightness and overcoming bus capacitance.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

In each functional block diagram, a single line between functional blocks represents one or more signals. Signals that appear on several figures and have the same mnemonic are directly or indirectly coupled together. Signal mnemonics generally correspond to the active, asserted, logic level of the signal's function. The voltages corresponding to the logic levels of the various signals are not necessarily identical among the various signals.

DESCRIPTION

Figure 1:
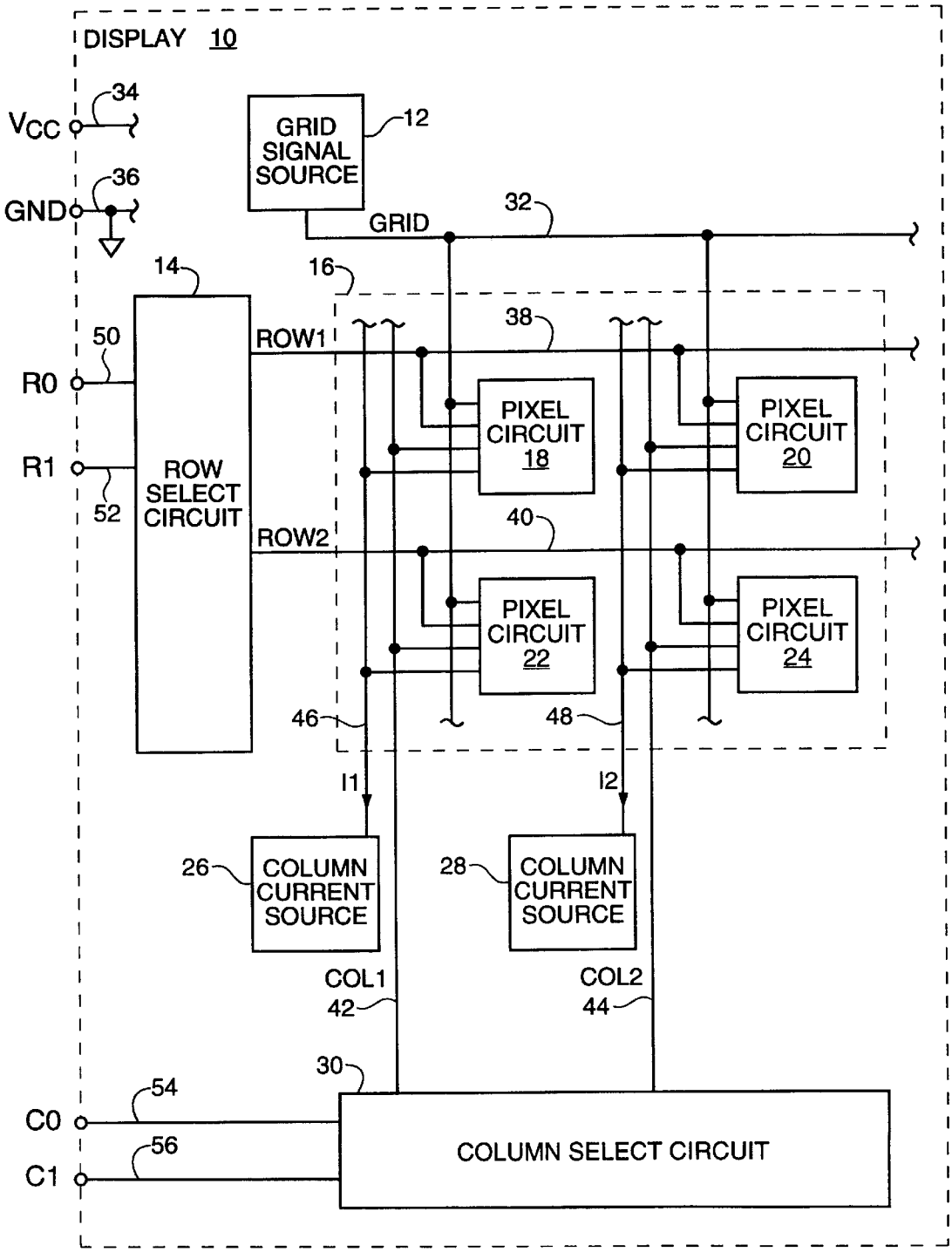
FIG. 1 is a functional block diagram of a display of the present invention.

FIG. 1 is a functional block diagram of a display of the present invention. Display 10 is a field emission display including an array 16 of four pixel circuits, one per pixel; row and column select circuits 14 and 30, respectively; and signal sources 12, 26, and 28. Display 10 receives row signals R0 and R1 on lines 50 and 52; and receives column signals C0 and C1 on lines 54 and 56. Row and column signals operate for selecting a pixel to illuminate.

The architecture of display 10 is representative of field emission displays having thousands of pixel circuits. Display 10 is of the type described in U.S. Pat. No. 5,210,472 incorporated herein by reference. Display 10 includes two rows and two columns. Pixel circuits 18 and 20, being responsive to signal ROW1 on line 38 form a first row. Pixel circuits 18 and 22, being responsive to column signal COL1 on line 42 form a first column. A pixel circuit being connected to a row signal and a column signal is said to be at the intersection of a row and a column. No particular geometric relationship necessarily exists among rows and columns, though pixel circuits 18–24 are in a two dimensional orthogonal matrix for efficient packing density and consequently high display resolution.

Row and column signals, as received by display 10, are binary digital signals. Row select circuit 14 and column select circuit 30 cooperate as means for identifying a display cell, i.e. a pixel circuit. Row signals R0 and R1 together convey a binary row number from 0 to 3. Row select circuit 14 decodes row signals R0 and R1 and activates one of four decoded row signals, e.g. ROW1 on line 38. Array 16 shows two of the 4 addressable rows, the remaining rows omitted for clarity. Likewise, column signals C0 and C1 together convey a binary column number from 0 to 3. Column select circuit 30 decodes column signals C0 and C1 and activates one of four decoded column signals, e.g. COL1 on line 42. When the pixel corresponding to pixel circuit 18, is to be illuminated, the ROW1 and COL1 signals enable illumination. In an alternate embodiment, row and column signals are received by display 10 on a multiplexed bus.

Each pixel circuit 18–24 is connected to grid signal source 12 by line 32. Grid signal GRID on line 32 provides an accelerating potential on a grid structure within each pixel circuit. Those of ordinary skill in the art realize that the voltage of signal GRID depends on several design choices including the display color, brightness, and persistence; the method of addressing the display; the materials selected for the target, the tip, and the grid; the layout and intrinsic capacitance of matrix conductors; and, the dimensions and dimensional relationships among the tip, the grid, and the target.

Column current source 26 supplies current I1 to pixel circuits 18 and 22 of the first column of array 16. Current I1 is supplied to the emission tip of pixel circuit 18 via line 46. Line 46 forms a bus for coupling current I1 to one of a plurality of pixel circuits. Electrons from current I1 are accelerated and focussed by signal GRID to excite a small area of phosphor 72 on a display target, (see FIG. 2). Current I1 has a magnitude in the range of a few nanoamps to a few hundred nanoamps depending on the design choices listed above with regard to the voltage of signal GRID.

In one embodiment, source 26 supplies all pixel circuits of the column. For display 10, substantially all of current I1 flows to one pixel circuit due to the operation of select circuits 14 and 30 which activate only one selection signal at a time.

In an alternate embodiment, source 26 supplies a subset of pixel circuits. Each pixel circuit of the subset is part of the same column, though each pixel circuit of the subset is part of a different row. In yet another alternate embodiment, a portion of current I1 simultaneously flows to each enabled pixel circuit.

In still another embodiment, a column current source is coupled to supply current to more than one column and more than one pixel in a subset is enabled simultaneously by operation of alternate row and column select circuitry. If a predetermined total current is supplied to a varying number of enabled pixel circuits, the brightness of displayed pixels may also vary.

Display 10 is manufactured using conventional semiconductor fabrication processes including, for example, MOS and CMOS processes. All of the circuitry of display 10 is integrated on a single die. Array 16 is formed in a region of the die that geometrically corresponds to the aspect ratio and resolution of the completed display device. Such a region may be identifiable by circumscribing an imaginary contour on the surface of the die. Peripheral circuitry is then located outside the contour. For displays of the highest resolution, the layout of array 16 excludes peripheral circuitry including grid signal source 12, select circuits 14 and 30, and column current sources 26 and 28. By eliminating current sources from array 16, display 10 employs smaller pixel circuits than conventional displays, and a higher resolution display results.

Figure 2:
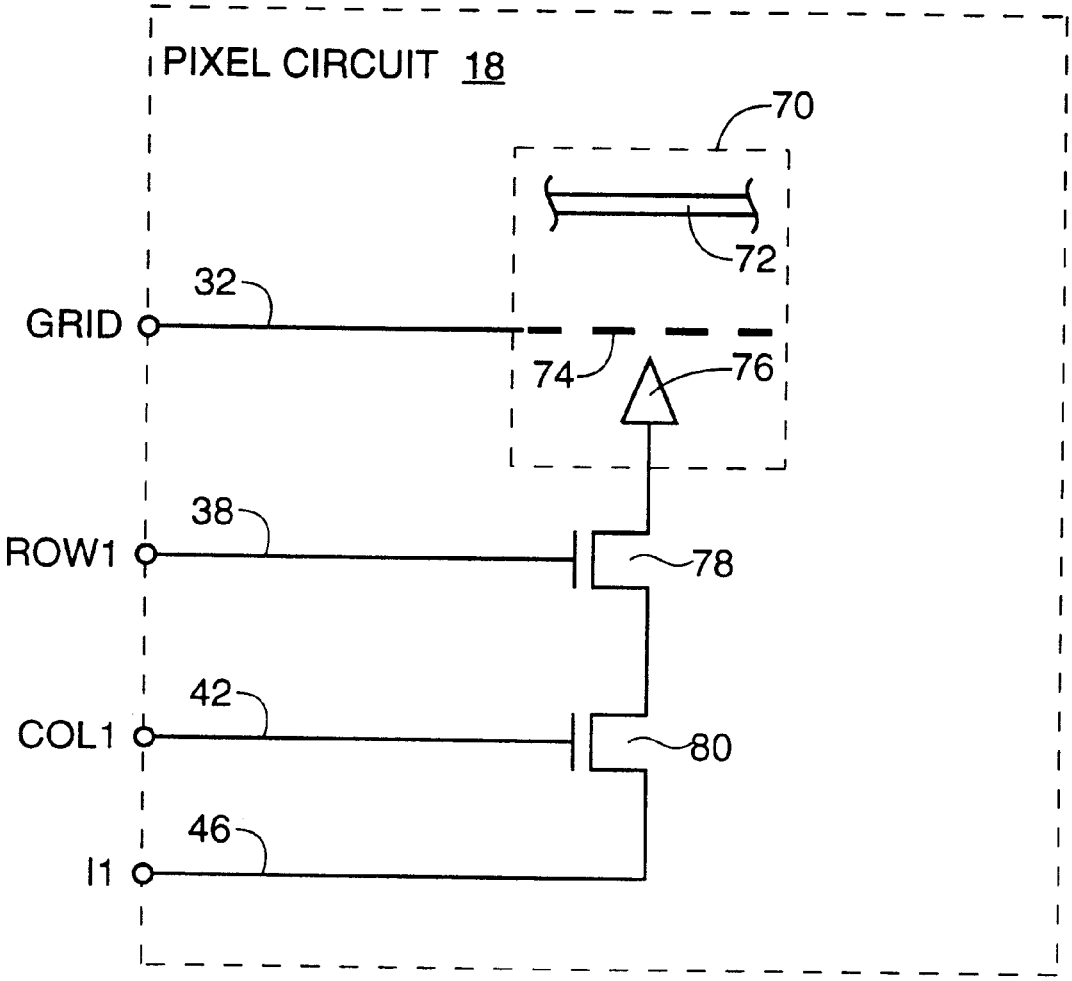
FIG. 2 is a functional block diagram of a pixel circuit of the type shown in FIG. 1.

FIG. 2 is a functional block diagram of a pixel circuit of the type shown in FIG. 1. Pixel circuits 18–24 of display 10 are identical to the pixel circuit shown in FIG. 2. Pixel circuit 18 includes pixelator 70 row select transistor 78, and column select transistor 80. Pixelator 70 includes emission tip 76 from which an electron beam is emitted, grid 74 for accelerating and focusing the beam. A portion of the target is shown as phosphor 72.

In the physical structure of pixel circuit 18, transistors 78–80 and tip 76 are formed in a semiconductor substrate and grid 74 is above tip 76. Phosphor 72 is part of a phosphor target located above the semiconductor substrate of display 10.

When signals ROW1 and COL1 are received by pixel circuit 18, transistors 78 and 80 conduct current I1 from line 46 in series to tip 76. The potential of tip 76 is maintained by proximity to grid 74 and so approximates the voltage of signal GRID on line 32. The potential on line 46 is somewhat less than the GRID voltage when transistors 78 and 80 are conducting. Current I1 is supplied from column current source 26, as described above, and from the intrinsic capacitance associated with the structure and physical layout of line 46.

Figure 3:
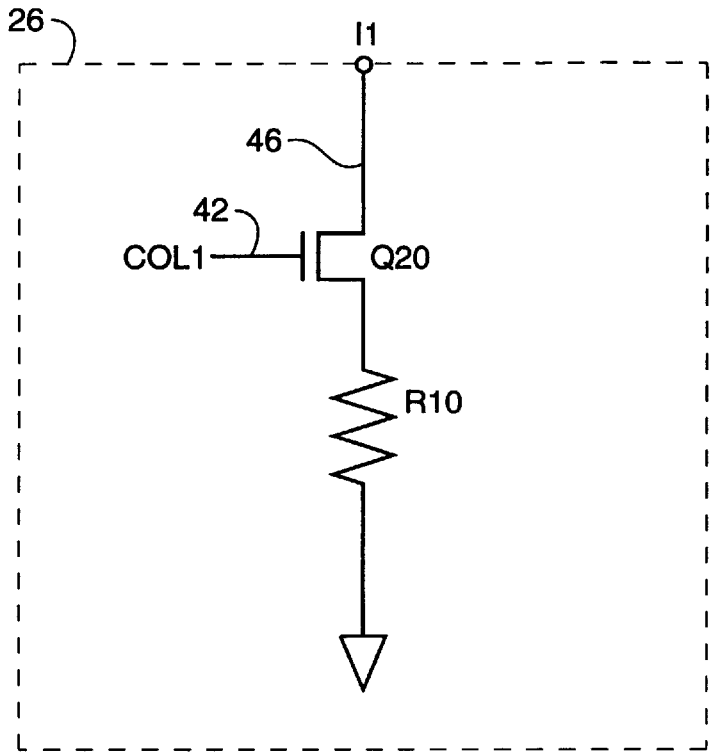
FIG. 3 is a schematic diagram of a current source shown in FIG. 1.

FIG. 3 is a schematic diagram of column current source 26 shown in FIG. 1. The electron flow that forms current I1 flows from ground through resistor R10 and through isolation transistor Q20. Isolation transistor Q20 conducts in response to column signal COL1. When signal COL1 is not asserted, the intrinsic capacitance on line 46 is isolated from discharging through resistor R10. By maintaining the charge on line 46, current for an electron beam from tip 76 is readily available and pixel circuit 18 can rapidly respond to being enabled by row and column signals.

In an alternate embodiment, transistor Q20 is omitted. In such an embodiment, response time is slower. Beneficially, however, resolution is increased and fabrication costs are decreased. Decreased circuit complexity reduces fabrication costs.

In another alternate embodiment, transistor 80 shown in FIG. 2 is omitted. Column selection in such an embodiment is performed by transistor Q20. When transistor Q20 is not conducting and row signal ROW1 is received, discharge of the intrinsic capacitance on line 46 may result. The advantages of increased resolution from omitting transistor 80 and thereby reducing the size of pixel circuit 18 overcome the disadvantage of slower response time for this embodiment.

Figure 4:
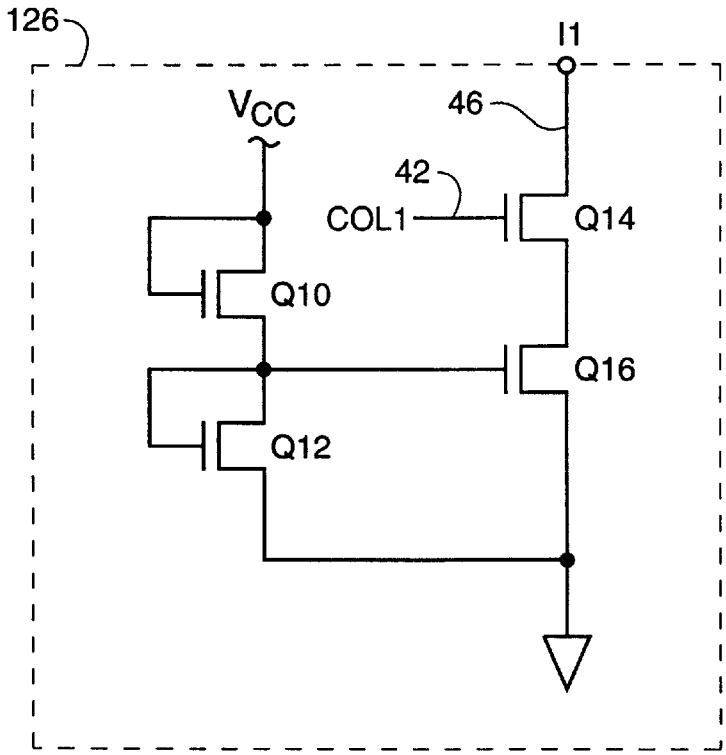
FIG. 4 is a schematic diagram of an alternate current source.

FIG. 4 is a schematic diagram of an alternate current source. Current source 126 includes a voltage divider formed of transistors Q10 and Q12. The voltage divider output is connected to the gate of transistor Q16 to establish a controlled resistance in the channel of Q16. The gate operates as a control element of transistor Q16. The electron flow that forms current I1 flows from ground through transistor Q16 and through isolation transistor Q14. The operation of isolation transistor Q14 is similar to the operation of isolation transistor Q20 discussed with reference to FIG. 3.

The foregoing description discusses preferred embodiments of the present invention, which may be changed or modified without departing from the scope of the present invention.

For example, P-channel FETs discussed above may be replaced with N-channel FETs (and vice versa) in some applications with appropriate polarity changes in controlling signals as required. Moreover, the P-channel and N-channel FETs discussed above generally represent active devices which may be replaced with bipolar or other technology active devices.

As another example, row and column signals and address decoders of display 10 cooperate as means for parallel writing of the display. These may be replaced with shift registers for identifying rows and columns in a regular scanning sequence. Shift registers in conjunction with clock signals received by the display cooperate as means for serially writing the display. Other serial interface architectures are equivalent including counter-decoder architectures known in serial access memory device technologies.

These and other changes and modifications are intended to be included within the scope of the present invention. While for the sake of clarity and ease of description, several specific embodiments of the invention have been described; the scope of the invention is intended to be measured by the claims as set forth below. The description is not intended to be exhaustive or to limit the invention to the form disclosed. Other embodiments of the invention will be apparent in light of the disclosure to one of ordinary skill in the art to which the invention applies.

For example, in display 10 a pixel is illuminated by direct current drive signals GRID on line 32 and I1 on bus 46. In alternate and equivalent embodiments, the equivalent of bus 46 conducts a drive signal appropriate for the illumination or absorption of energy as appropriate for the mechanism of the pixel circuit of such an embodiment. Hence, in the embodiment described in FIG. 1, column current source 26 is one embodiment of means for providing the drive signal so that an identified cell displays a pixel. In another alternate embodiment, an alternating current drive signal is supplied to a pixel circuit including a liquid crystal element. In a variation of this embodiment, the liquid crystal serves as means for light modulation, for example, as a shutter in an optical processing system.

The words and phrases used in the claims are intended to be broadly construed. A "display" refers generally to an optical element, light modulator, light emitter, light emitting diode, infrared emitting device, electromagnetic energy emitting or absorbing device, combinations thereof, and equivalents.

The word "supply" refers to a signal source, signal generator, or signal regulator, combinations thereof, and equivalents. The supply operates to form a drive signal on a bus by operating on the intrinsic capacitance of the bus so as to charge, discharge, regulate, couple, isolate, maintain, reverse, or modulate the signal conveyed by the bus.

A "signal" refers to mechanical and/or electromagnetic energy conveying information. When elements are coupled, a signal can be conveyed in any manner feasible in light of the nature of the coupling. For example, if several electrical conductors couple two elements, then the relevant signal comprises the energy on one, some, or all conductors at a given time or time period. When a physical property of a signal has a quantitative measure and the property is used by design to control or communicate information, then the signal is said to be characterized by having a "value." The amplitude may be instantaneous or an average. For a binary (digital) signal, the two characteristic values are called logic levels, "high" and "low."

What is claimed is:

1. A field emission display comprising:

a plurality of pixels arranged in an array of intersecting rows and columns so that one pixel is located at each intersection of a row and a column, wherein each pixel includes a number of field emitter tip electrodes, and a pixel switching circuit having an input and an output, the output of the pixel switching circuit being connected to the field emitter tip electrodes of said pixel, wherein the pixel switching circuit controllably allows and prevents current flow between the input of the pixel switching circuit and the field emitter tip electrodes of said pixel; and a plurality of column current sources, wherein each column current source is associated with a distinct one of the columns of the array, and each column current source includes an output through which the column current source supplies an electrical current having a value controlled by said column current source;

wherein, for each column, the inputs of all of the pixel switching circuits in said column are connected to receive the current supplied by the output of the column current source associated with said column.

2. A display according to claim 1, wherein:

all of the pixels are positioned inside a peripheral contour; and all of the column current sources are positioned outside the peripheral contour.

3. A display according to claim 1, further comprising:

a row select circuit for producing a row select signal for each row of the display; and a column select circuit for producing a column select signal for each column of the display;

wherein the pixel switching circuit of each pixel is controlled by the row select signal for the row in which the pixel is located; and wherein the column current source of each column is controlled by the column select signal for said column.

4. A display according to claim 3, wherein:

the column current source of each column comprises a transistor having a gate and a channel, the gate being connected to receive the column select signal for said column, and the channel being connected in series with the output of said column current source; and the pixel switching circuit of each pixel comprises a transistor having a gate and a channel, the gate being connected to receive the row select signal for the row in which said pixel is located, and the channel being connected in series between the field emitter electrodes of said pixel and the output of the column current source of the column in which said pixel is located.

5. A display according to claim 4, wherein:

each column current source further comprises a resistance device having first and second terminals, the first terminal of each resistance device being connected to an electrical ground; and the channel of the transistor of each column current source is connected between the output of said column current source and the second terminal of the resistance device of said column current source.

6. A display according to claim 3, wherein the pixel switching circuit of each pixel comprises:

first and second transistors, each transistor having a channel and a gate, wherein the respective channels of the first and second transistors of the pixel switching circuit of each pixel are connected together in series between the field emitter electrodes of said pixel and the output of the column current source of the column in which said pixel is located, the gate of the first transistor of the pixel switching circuit of each pixel is connected to receive the row select signal for the row in which said pixel is located; and the gate of the second transistor of the pixel switching circuit of each pixel is connected to receive the column select signal for the column in which said pixel is located.

7. A display according to claim 1, wherein each column current source comprises a column current control circuit, connected between the output of said column current source and an electrical ground, that controls said value of said current supplied through the output of said column current source.

8. A method of supplying electrical current to pixels of a field emission display, comprising the steps of:

arranging a plurality of pixels in an array of intersecting rows and columns so that one pixel is located at each intersection of a row and a column, wherein each pixel includes a number of field emitter tip electrodes;

providing in each pixel a distinct pixel switching circuit having an input and an output, wherein each pixel switching circuit controllably allows and prevents current flow between its input and its output;

in each pixel, coupling the current flow from the output of the pixel switching circuit of said pixel to the field emitter tip electrodes of said pixel;

providing a plurality of controllable column current sources, wherein each column current source is associated with a distinct one of the columns of the array, and wherein each column current source includes an output through which the column current source controllably supplies electrical current;

in each column, connecting the inputs of all the pixel switching circuits in said column to receive the current supplied by the output of the column current source associated with said column; and in each column, controlling the current supplied by the output of the column current source of said column.

9. A method according to claim 8, further comprising the steps of:

positioning all of the pixels inside a peripheral contour; and positioning all of the column current sources outside the peripheral contour.

10. A method according to claim 8, further comprising the steps of:

producing a row select signal for each row of the display;

producing a column select signal for each column of the display;

controlling the state of the pixel switching circuit of each pixel in response to the row select signal for the row in which the pixel is located; and controlling the column current source of each column in response to the column select signal for said column.

11. A method according to claim 10, wherein:

the step of providing a plurality of controllable column current sources for each column further comprises the steps of:

providing in said column current source a transistor having a channel and a gate, connecting the channel of the transistor of said column current source in series with the output of said column current source, and connecting the gate of the transistor of said column current source to receive the column select signal for said column; and the step of providing a pixel switching circuit in each pixel further comprises the sub-steps of:

providing in each pixel switching circuit a transistor having a channel and a gate;

connecting the channel of the transistor of the pixel switching circuit of each pixel in series between the field emitter electrodes of said pixel and the output of the column current source of the column in which said pixel is located, and connecting the gate of the transistor of the pixel switching circuit of each pixel to receive the row select signal for the row in which the pixel is located.

12. A method according to claim 11, wherein:

the step of providing a plurality of controllable column current sources further comprises the steps of providing in each column current source a resistance device having first and second terminals, and in each column current source, connecting the first terminal of the resistance device of said column current source to the output of said column current source; and the step of connecting the channel of the transistor of each column current source comprises connecting the channel of the transistor of each column current source between the output of said column current source and the second terminal of the resistance device of said column current source.

13. A method according to claim 10, further comprising the steps of:

providing first and second transistors in the pixel switching circuit of each pixel, wherein each transistor has a gate and a channel;

connecting the channels of the first and second transistors of the pixel switching circuit of each pixel in series between the field emitter electrodes of said pixel and the output of the column current source of the column in which said pixel is located;

connecting the gate of the first transistor of the pixel switching circuit of each pixel to receive the row select signal for the row in which the pixel is located; and connecting the gate of the second transistor of the pixel switching circuit of each pixel to receive the column select signal for the column in which the pixel is located.

14. A method according to claim 8, wherein the step of providing a column current source for each column comprises:

connecting a column current control circuit in each column current source between the output of said column current source and an electrical ground.

15. A circuit for controlling the electrical current flow through a number of field emission tip electrodes in response to an electrical control signal, comprising:

a number of field emission tip electrodes; and first and second field effect transistors, each transistor having a source, a drain, and a gate, wherein the source of the first transistor is connected to the drain of the second transistor, the drain of the first transistor is connected to the field emission tip electrodes, and the respective gates of both transistors are connected to each other and are connected to receive the control signal.

16. A circuit according to claim 15, wherein the source of the second transistor is connected to an electrical ground.

17. A circuit according to claim 15, further comprising a resistance device connected between the source of the second transistor and an electrical ground.

18. A circuit according to claim 17, wherein the resistance device is a resistor.

19. A circuit according to claim 17, wherein the resistance device is a transistor biased to provide a controlled resistance.

20. A circuit according to claim 15, wherein the connection between the source of the first transistor and the drain of the second transistor comprises an electrical conductor line having substantial capacitance.

21. A circuit according to claim 15, wherein:

the second transistor is positioned at a first distance from the first transistor; and each of the field emission tip electrodes is positioned at a distance from the first transistor which is substantially less than said first distance.

22. A circuit according to claim 15, further comprising:

a third transistor connected in series between the drain of the first transistor and said number of field emission tip electrodes, wherein the third transistor includes a source electrode connected to the drain electrode of the first transistor, a drain electrode connected to said number of field emission tip electrodes, and a gate electrode connected to receive a row selection electrical signal;

wherein the control signal connected to the gates of the first and second transistors is a column selection signal.

23. A field emission display having a plurality of pixels whose luminance is controlled by one or more electrical control signals, comprising:

(a) a plurality of pixels arranged in an array of intersecting rows and columns so that one pixel is located at each intersection of a row and a column, wherein each pixel includes (1) a number of field emission tip electrodes, and (2) a first transistor having a source, a drain, and a gate, wherein (i) the drain is connected to the field emission tip electrodes of the pixel, and (ii) the gate is connected to receive one of the control signals; and (b) a plurality of column current sources, wherein (1) each column current source is associated with a distinct one of the columns of the array, and (2) the column current source of each column includes a transistor having a source, a drain, and a gate, wherein (i) the drain is connected to the source of the first transistor of each pixel located in said column, and (ii) the gate is connected to the gate of the first transistor of each pixel located in said column.

24. A display according to claim 23, wherein:

all of the pixels of the display are positioned inside a peripheral contour, and all of the column current sources of the display are positioned outside the peripheral contour.

25. A display according to claim 23, wherein the connection between the source of the first transistor of each pixel and the drain of the transistor of the column current source of the column containing said pixel comprises an electrical conductor line having substantial capacitance.

26. A display according to claim 23, wherein each pixel further comprises:

a second transistor connected in series between the drain of the first transistor of the pixel and the field emission tip electrodes of the pixel, wherein the second transistor includes a source connected to the drain of the first transistor of the pixel, a drain connected to the field emission tip electrodes of the pixel, and a gate connected to receive a row selection electrical signal;

wherein the control signal connected to the gate of the first transistor of said each pixel is a column selection signal.

27. A display according to claim 23, wherein the source of the transistor of each column current source is connected to an electrical ground.

28. A display according to claim 23, wherein each column current source further comprises:

a resistance device connected between the source of the transistor of the column current source and an electrical ground.

29. A display according to claim 28, wherein the resistance device is a resistor.

30. A display according to claim 28, wherein the resistance device is a transistor biased to provide a controlled resistance.

31. A method for controlling the electrical current flow through a number of field emission tip electrodes in response to an electrical control signal, comprising the steps of:

providing a number of field emission tip electrodes;

providing first and second field effect transistors, each transistor having a source, a drain, and a gate;

connecting the source of the first transistor to the drain of the second transistor;

connecting the drain of the first transistor to the field emission tip electrodes;

connecting together the respective gates of the two transistors; and connecting the respective gates of both transistors to receive the control signal.

32. A method according to claim 31, further comprising the step of:

connecting the source of the second transistor to an electrical ground.

33. A method according to claim 31, further comprising the step of:

connecting a resistance device between the source of the second transistor and an electrical ground.

34. A method according to claim 33, wherein the resistance device is a resistor.

35. A method according to claim 33, wherein:

the resistance device is a transistor; and the step of connecting the resistance device further comprises biasing the transistor to provide a controlled resistance.

36. A method according to claim 31, wherein the step of connecting the source of the first transistor to the drain of the second transistor comprises:

connecting an electrical conductor line having substantial capacitance between the source of the first transistor and the drain of the second transistor.

37. A method according to claim 31, further comprising the steps of:

positioning the second transistor at a first distance from the first transistor; and positioning each of the field emission tip electrodes at a distance from the first transistor which is substantially less than said first distance.

38. A method according to claim 31, further comprising the steps of:

providing a third transistor having a source, a drain, and a gate;

connecting the source of the third transistor to the drain of the first transistor;

connecting the drain of the third transistor to the field emission tip electrodes; and connecting the gate of the third transistor to receive a row selection electrical signal;

wherein the control signal connected to the gates of the first and second transistors is a column selection signal.

39. A method of controlling the luminance of a plurality of pixels in a field emission display in response to one or more electrical control signals, comprising the steps of:

arranging a plurality of pixels in an array of intersecting rows and columns so that one pixel is located at each intersection of a row and a column;

providing in each pixel a number of field emission tip electrodes;

providing in each pixel a first transistor having a source, a drain, and a gate;

connecting the drain of the first transistor of each pixel to the field emission tip electrodes of the pixel;

connecting the gate of the first transistor of each pixel to receive one of the control signals;

providing a plurality of column current sources, wherein each column current source is associated with a distinct one of the columns of the array;

providing in each column current source a transistor having a source, a drain, and a gate;

connecting the drain of the transistor of the column current source of each column to the source of the first transistor of each pixel located in said column; and connecting the gate of the transistor of the column current source of each column to the gate of the first transistor of each pixel located in said column.

40. A method according to claim 39, further comprising the steps of:

positioning all of the pixels of the display inside a peripheral contour; and positioning all of the column current sources of the display outside the peripheral contour.

41. A method according to claim 39, wherein the step of connecting the drain of the transistor of the column current source of each column to the source of the first transistor of each pixel located in said column comprises:

connecting an electrical conductor line having substantial capacitance between the drain of the transistor of the column current source of each column and the source of the first transistor of each pixel located in said column.

42. A method according to claim 39, further comprising the steps of:

providing in each pixel a second transistor having a source, a drain, and a gate;

connecting the source of the second transistor of each pixel to the drain of the first transistor of said pixel;

connecting the drain of the second transistor of each pixel to the field emission tip electrodes of the pixel; and connecting the gate of the second transistor of each pixel to receive a row selection electrical signal;

wherein the control signal connected to the gate of the first transistor of said each pixel is a column selection signal.

43. A method according to claim 39, further comprising the step of:

connecting the source of the transistor of each column current source to an electrical ground.

44. A method according to claim 39, further comprising the steps of:

providing a resistance device in each column current source; and connecting the resistance device of each column current source between the source of the transistor of the column current source and an electrical ground.

45. A method according to claim 44, wherein the resistance device is a resistor.

46. A method according to claim 44, wherein:

the resistance device is a transistor; and the step of connecting the resistance device further comprises biasing the transistor to provide a controlled resistance.

* * * * *